United States Patent [19]

Zaccardelli et al.

[11] Patent Number: 5,044,138

[45] Date of Patent: Sep. 3, 1991

[54] CEILING SUSPENSION STRUCTURE ADAPTED FOR UNOPPOSED INTERSECTIONS

[75] Inventors: Michael R. Zaccardelli, North Royalton; Gerald L. Koski, Parma, both of Ohio

[73] Assignee: USG Interiors, Inc., Chicago, Ill.

[21] Appl. No.: 421,225

[22] Filed: Oct. 13, 1989

[51] Int. Cl.[5] ..... E04B 9/06

[52] U.S. Cl. ..... 52/667; 52/484; 52/488; 52/664

[58] Field of Search ..... 52/664, 667, 488, 484, 52/729, 737, 738, 739, 666, 669; 403/347

[56] References Cited

U.S. PATENT DOCUMENTS

| | | | |
|---|---|---|---|
| 3,308,288 | 3/1967 | Ades | 52/664 |
| 4,108,563 | 8/1978 | Brown et al. | 403/347 |
| 4,548,013 | 10/1985 | Briceno | 52/484 |

FOREIGN PATENT DOCUMENTS

| | | | |
|---|---|---|---|
| 205673 | 12/1986 | European Pat. Off. | 52/484 |
| 1112821 | 8/1961 | Fed. Rep. of Germany | 52/484 |

*Primary Examiner*—Michael Safavi

*Attorney, Agent, or Firm*—Robert H. Robinson; John M. Lorenzen

[57] ABSTRACT

A suspended ceiling structure adapted for unopposed intersections wherein the webs of the main grid runners adjacent the cross runner slots are provided with embossments which strengthen the web and contain the cross runner end connector against withdrawal. It is preferred that the embossments are placed at each side of the cross runner slots. The cross runner end connectors have tabs bent laterally from the longitudinal axis of the cross runners with the rearward edge of the tab bearing against the face of the main runner web, whereby upon the application of a pull out force, the tab edge bends outwardly until it presses against the ends of the embossments. This unopposed intersection structure is commonly referred to in the art as an "ashlar" condition or configuration.

8 Claims, 2 Drawing Sheets

CEILING SUSPENSION STRUCTURE ADAPTED FOR UNOPPOSED INTERSECTIONS

BACKGROUND OF THE INVENTION

1. Field of the Invention

This invention relates to ceiling suspension systems of the type having longitudinally extending runners and transverse cross runners forming openings for receiving and supporting panels or fixtures, and more particularly to such a system adapted for the intersection of an end of a cross runner with an intermediate part of a main runner and the absence of corresponding cross runner at the opposite side of the main runner. Such an intersection will be referred to as an "ashlar" condition or configuration.

2. Prior Art

Suspended ceiling system are well known and widely used. Usually, these systems have elongated main runners and cross runners in the form of inverted tees which are suspended from structures above by wires in a grid arrangement. The main runners are parallel and spaced with cross runners extending transversely therebetween forming grid openings. Ceiling panels, light fixtures or the like are placed in the openings supported by the flanges of the runners. The main runners have slots or openings in their vertical webs where the cross runners intersect therewith, and the cross runners have connectors on their ends which extend through the slots and mate with colinear cross runners on the opposite sides of the main runners.

An example of such a conventional system is shown in U.S. Pat. No. 4,108,563. Connector clips are attached to the ends of mating cross runners, these clips being inserted from opposing sides through a vertical slot in the web of the main runner. The connectors are formed with tabs and slots which engage each other and the web of the main runner to resist forces tending to pull out the cross runners. The combination of these interconnections makes the structure highly resistant to pullout forces.

It may desired to install a suspended ceiling system where some or all of the intersections are in the ashlar condition, i.e., there being a single cross runner at points of intersection with the main runner. However, such installations must still meet the requirements of building codes, including adequate pullout strength to resist forces caused by seismic disturbances. The mere modification of conventional grids by omitting cross runners at intersections will usually result in insufficient pullout strength. The slots in the main runners, which were designed for the insertion of two connectors, will be too loose for a single connector. Furthermore, with the absence of an interconnection with an opposing cross runner, there will be less resistance to pullout forces and increased stress on the web of the main runners near the slots, possibly resulting in failure of the web.

SUMMARY OF THE INVENTION

The present invention provides a suspended ceiling grid structure adapted for the ashlar condition wherein the webs of the main runners adjacent the cross runner slots are provided with sets of embossments which strengthen the web and contain the cross runner end connectors against withdrawal. In a preferred embodiment, at each side of a slot at an intersection there are formed six spaced, parallel, longitudinally extending ridges or embossments, three at each side of the slot. On one side of the slot are the first set of three embossments, the upper and lower ones convexly protruding in the direction of insertion of the cross runner. The intermediate embossment is convex to the opposite side of the main runner web. The set of three embossments on the other side of the slot is similar, but protrudes oppositely from the first set.

The end connectors have tabs bent laterally from the longitudinal axis of the cross runners. With an end connector inserted through a slot, the rearward edge of the tab bears against the face of the main runner web near the ends of the upper and lower embossments thus preventing withdrawal of the cross runners. Upon the application of pullout force, the tab edge bends outwardly until it presses against the ends of the upper and lower embossments at which point the connector is captured against any further withdrawal. The embossments add strength to the web to resist the concentrated force.

DESCRIPTION OF THE PREFERRED EMBODIMENTS

Figure 1:
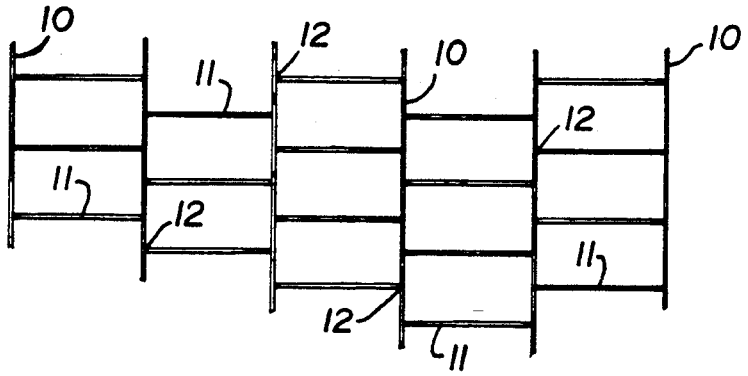
FIG. 1 is a fragmentary, diagrammatic plan of the main runners and cross runners of a suspended ceiling having ashlar condition intersections.

By way of disclosure of a preferred embodiment of the invention, and not by way of limitation, there is shown in the drawings a suspended ceiling structure wherein cross runners intersect with main runners without opposing cross runners at the intersections. As shown in FIG. 1, the structure comprises a grid of spaced, parallel and longitudinally extending main runners 10 and spaced, parallel, laterally extending cross runners 11 bridging the main runners 10, thereby forming a number of rectangular openings for receiving ceiling panels, light fixtures, air vents and the like. At each of the intersections 12 of the main runners with the cross runners there is but one cross runner. In other words, the intersections are in the ashlar configuration.

Figure 2:
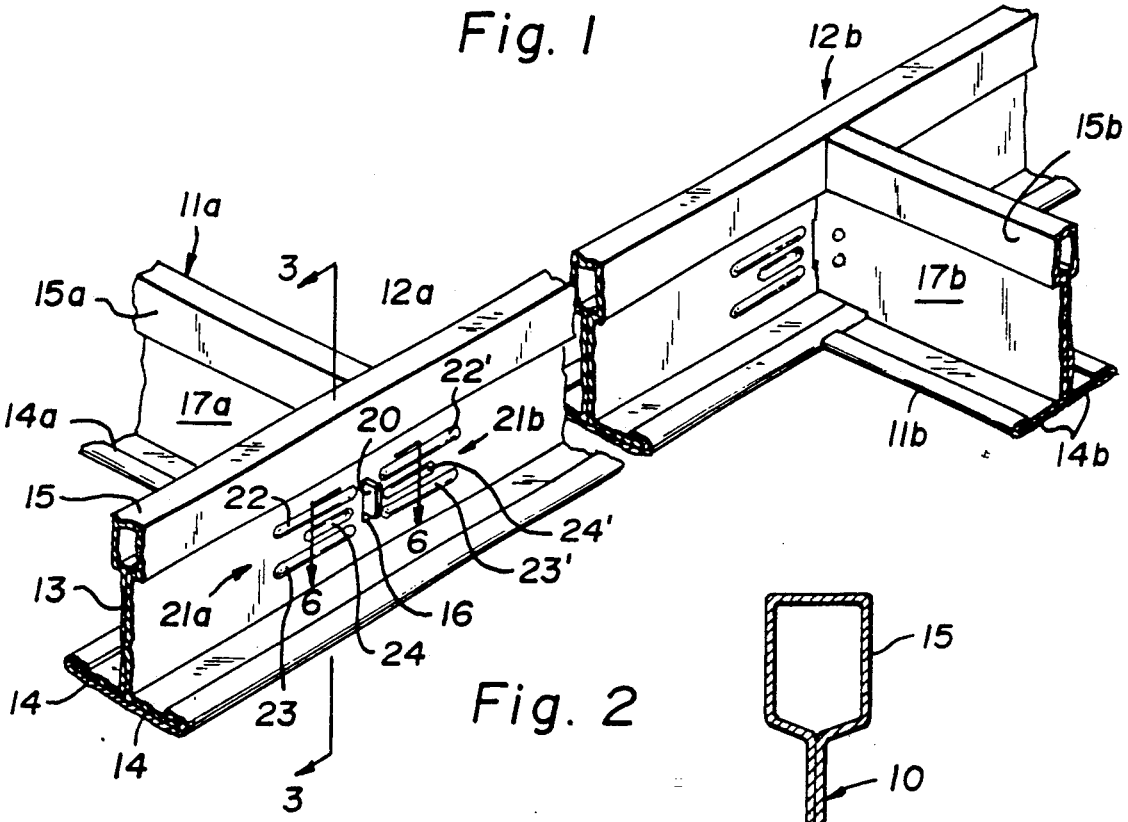
FIG. 2 is a fragmentary, top and side, isometric view of two unopposed intersections according to a preferred embodiment of the invention.

FIG. 2 shows two adjacent intersections 12*a*, 12*b* in greater detail. The main runners 10 are in the form of inverted tees having a vertical web 13, outwardly extending flanges 14 at the bottom of the web, and a stiffening bulb 15 at the top of the web. The cross runners are formed similarly to the main runners having webs 17*a*, 17*b*, flanges 14*a*, 14*b*, and bulbs 15*a*, 15*b*. Where the intersections are to be situated, the main runners are provided with vertical, generally rectangular slots 16 sized appropriately to receive the connectors 20 at the ends of the cross runners.

Figure 3:
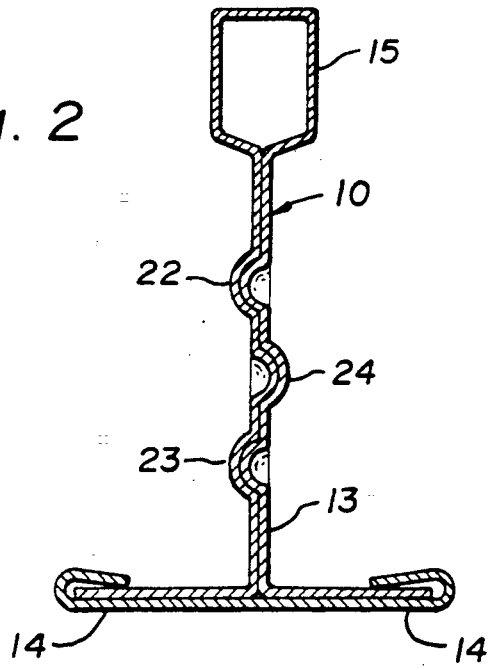
FIG. 3 is an enlarged sectional view taken along the line 3—3 of FIG. 2.

To either side of each of the slots 16, the web 13 of the main runner 10 is formed with three embossments 21*a*, 21*b* in the form of elongated, spaced, longitudinal ridges. As best seen in FIG. 3, each set of three ridges comprises upper and lower ridges 22, 23, and an intermediate ridge 24. The upper and lower ridges protrude convexly outward to a first lateral side of the main runner web 13 and the intermediate ridge protrudes convexly outwardly to the opposite, or second, lateral side of the web. These ridges 22, 23 and 24 increase the section modulus of the web and enhance its strength.

Figure 4:
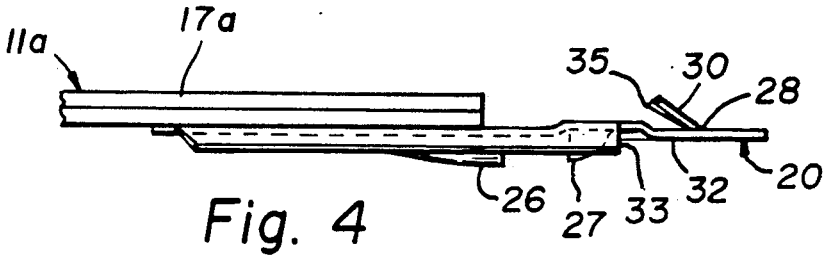
FIGS. 4 and 5 are top and side views, respectively of a cross runner end.
Figure 5:
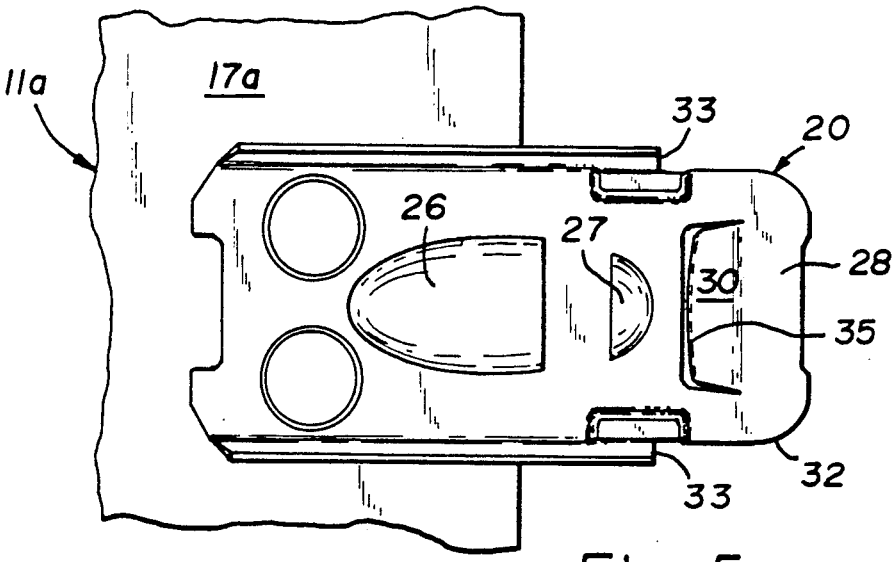

A cross runner end connector 20 suitable for use with the invention is shown in FIGS. 4 and 5. The connector is substantially similar to that disclosed in the aforementioned U.S. Pat. No. 4,108,563. Certain features of the connector such as the bulges 26 and 27 are not operative in an ashlar condition, but such features are shown here to point out that standard connectors may be used in practicing the present invention without extensive modification. One modification made to the connector with respect to the patent disclosure is the absence of a hole in the area indicated by reference 28. This area is left solid to increase the strength of the tab 30 and its resistance to bending outwardly.

In its general organization, the end connector 20 includes an end projection 32 which fits through the slots 16 of the main runner webs, upper and lower shoulders 33 which abut the main runner webs upon full insertion of the connectors into the slots, and a tab 30 which is lanced in a U-shaped cut in the end projection and bent laterally outwardly. The rear edge 35 of the tab 30 is directed rearwardly toward the cross runner 11*a*.

Figure 6:
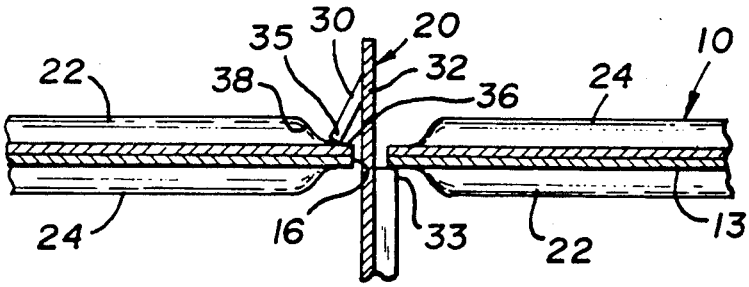
FIG. 6 is a top, enlarged, diagrammatic view of an unopposed intersection according to the invention taken substantially along the line 6—6 of FIG. 2.

FIG. 6, in which some structure is not pictured for clarity, shows in detail the relationship and cooperation of the end connector 20 with the main runner 10. When the connector end 32 is inserted into the slot 16, the tab 30 first flexes inwardly until it has passe entirely through the slot. Upon full insertion the tab then springs outwardly with the tab end 35 resting against the narrow flat portion 36 of the main runner web disposed between the slot 16 and the ends 38 of the ridges 22 and 23 (not visible in this view). The shoulders 33 touch the main runner web 13 thus locking the connector in place.

Figure 7:
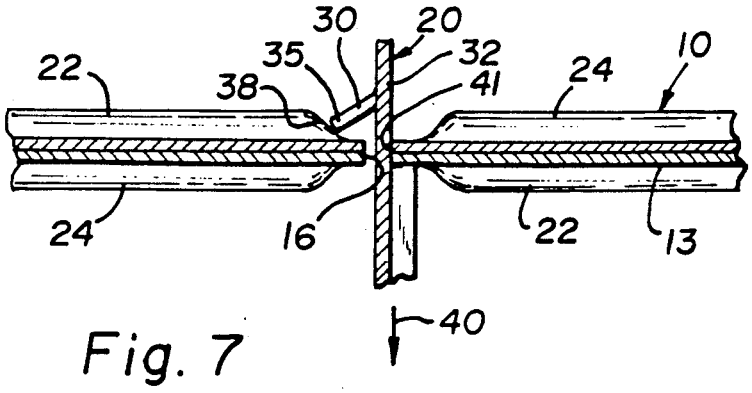
FIG. 7 is similar to FIG. 6 but showing the intersection subject to pullout forces on the cross runner.

In FIG. 7, pullout force as represented by arrow 40 is applied causing the end connector to withdraw slightly. The pullout force further causes the tab to bend more outwardly until the tab edge 35 presses against the end of the ridge 22 and the connector shifts to the right and presses against the side of the slot as indicated at reference 41. At this point, further withdrawal of the connector is arrested and the added stress imposed on the main runner web 13 is borne by ridges 22, 23 and 24.

Referring once more to FIGS. 2 and 3, it is desirable that the vertical distance between embossments 22 and 23 be no greater that the vertical dimension of the connector tab 30 such that the tab edge 35 will be able to abut the adjacent ends of both embossments. Also, as best shown in FIG. 2, a second set of three embossments 22', 23' and 24' is formed in the main runner web 13 similarly to the embossments 22, 23, and 24 but protruding in opposite directions from the web 13. This allows for insertion of cross runner connectors from either direction with the proper coaction of the embossments and the connector.

While the invention has been described with reference to a particular preferred embodiment, it is to be understood that the invention may practiced with modifications and variations without departing from the scope and spirit of the appended claims.

What is claimed is:

1. A suspended ceiling structure adapted for unopposed intersection comprising:

at least one longitudinal main runner having an elongated, generally vertical web, said web formed with slot means at an intermediate portion of said main runner for receiving a connector and embossment means for reinforcing said web adjacent said slot means; and at least one transverse cross runner having an end intersecting said main runner with no colinearly opposing cross runner, said cross runner end having connector means engaging said slot means in said main runner web.

2. The suspended ceiling structure of claim 1 wherein said embossment means for reinforcing said web comprises a first plurality of ridges formed in said main runner web and protruding outwardly therefrom.

3. The suspended ceiling structure of claim 2 wherein said plurality of ridges comprises at least first and second spaced, parallel longitudinal embossments having ends adjacent to and slightly spaced apart from said slot means.

4. The suspended ceiling structure of claim 3 wherein said connector means comprises an end projection inserted through said slot means and having a laterally, outwardly bent tab, the tab having a rear edge resting against the portion of the main runner web disposed between the slot means and the ends of said first and second embossments, whereby, upon the application of pullout force to the cross runner, said tab flexes outwardly until said rear edge abuts said first and second embossment ends and arrests further pullout movement of said cross runner.

5. The suspended ceiling structure of claim 2 further comprising a second plurality of ridges formed in said main runner web disposed adjacent said slot means longitudinally opposite said first plurality of ridges and protruding outwardly from said web oppositely of said first plurality.

6. The suspended ceiling structure of claim 3 wherein said first and second embossments protrude convexly in the direction of insertion of the cross runner end connection means in said slot means.

7. The suspended ceiling structure of claim 6 further comprising a third embossment formed in said main runner web disposed parallel to and between said first and second embossments, protruding convexly outwardly from the side of the main runner web opposite to said convex protrusion of said first and second embossments.

8. The suspended ceiling structure of claim 5 wherein said first plurality of ridges comprises three substantially parallel ridges with the upper and lower ridge protruding convexly in the direction of insertion of the cross runner end connector means in said slot means, and the intermediate ridge protrudes convexly in the opposite direction from the upper and lower ridges.

* * * * *